US005920020A

United States Patent [19]

Korupp

[11] Patent Number: 5,920,020

[45] Date of Patent: Jul. 6, 1999

[54] RESONANCE BOX

[76] Inventor: Reimund Korupp, Marktplatz 4, D-69117 Heidelberg, Germany

[21] Appl. No.: 08/693,715

[22] Filed: Aug. 7, 1996

[30] Foreign Application Priority Data

Aug. 10, 1995 [DE] Germany ..... 195 29 482

[51] Int. Cl.[6] ..... G10D 13/08

[52] U.S. Cl. ..... 84/410

[58] Field of Search ..... 84/410, 291, 274, 84/275, 453, 327; 181/160

[56] References Cited

U.S. PATENT DOCUMENTS

| | | | |
|---|---|---|---|
| 1,814,624 | 7/1931 | Fleck | 181/160 |
| 3,096,677 | 7/1963 | Ryan | 84/421 |
| 3,561,314 | 2/1971 | MacEachron | 84/284 |
| 4,018,129 | 4/1977 | Hollander | 84/294 |

FOREIGN PATENT DOCUMENTS

| | | |
|---|---|---|
| 95058 | 11/1923 | Austria . |
| 406842 | 12/1924 | Germany . |
| 2513439 | 8/1976 | Germany . |
| 204260 | 7/1939 | Switzerland . |
| 2056741 | 3/1981 | United Kingdom . |

*Primary Examiner*—William M. Shoop, Jr.
*Assistant Examiner*—Shih-yung Hsieh
*Attorney, Agent, or Firm*—Paul Vincent

[57] ABSTRACT

The invention concerns a resonance box for tonal amplification of a string instrument acoustically connected therewith, in particular one being supported by means of an end pin. This type of resonance box should be configured in such a fashion that it facilitates a significant resonance effect which can be heard and felt and amplifies the sound of the corresponding string instrument in that region in which the tonal spectrum is weaker. This is achieved in that the resonance box (1) is acoustically optimized through choice of material, shape and sound holes (2). An advantageous embodiment provides for configuring the resonance box in a compactable fashion to assume a reduced volume.

24 Claims, 3 Drawing Sheets

RESONANCE BOX

BACKGROUND OF THE INVENTION

The invention concerns a resonance box for sound amplification of a string instrument acoustically connected therewith, in particular one which is supported by means of an end pin.

The need for sound amplification of this type is based on the hearing-psychological fact that high tones appear to be louder than middle or lower tones, at constant sound pressure, and therefore are more easily distinguished and more penetrating.

In the beginning of the 19th century the violoncello was no longer restricted to its former role of often simply being a general bass and accompanying instrument. It became increasingly used by composers as a solo instrument starting from the first sonatas with fortepiano (Beethoven, op. 5, composed 1796) up to the romantic solo concert with large orchestra (Dvořák, composed 1896). The solo repertoire largely included works with which the violoncello was utilized with piano or orchestra.

Known in the art of piano construction is the development from former softly sounding chamber musical instruments such as the square piano and the fortepiano up to the modern grand piano. With regards to wind instruments, either brass or woodwind, the choice of materials, acoustical research and modern production methods have likewise led to a significant amplification of the sound.

In contrast thereto, the string instruments of the violin family have not significantly changed for the last 400 years. Only the utilization of modern strings and the increased spring tension facilitated thereby in combination with a modification of the neck of the instrument has led to certain tonal changes.

The hearing-psychological fact mentioned above is advantageous largely for the violin. However, even the viola does not have the same strength. The cello and the double-bass occasionally require extreme sensitivity on the part of their musical partners.

Clearly, there is a small number of extremely high quality instruments made by Stradivari, Guarneri or Montagnana whose sound in all tonal regions can be considered to be extraordinarily large. These rare instruments, however, are extremely expensive, i.e. exceeding one-million-marks. In the middle price region cellists are often prepared to invest a hundred thousand marks and more for a good instrument, i.e. an instrument which not only sounds good but also has sufficient strength.

By means of the cello end pin upon which the cello (or the double-bass) is supported when being played, the vibrations of the instrument body are transferred practically without loss to the underlying structure. If the structure is constructed in such a fashion that it also vibrates, a significant hearable and feelable resonance effect is achieved which strengthens the sound of the cello (or the double-bass) precisely in the region in which the tonal spectrum is weak.

Concert halls and stages were formerly constructed from wood and had rather good resonance qualities. The increasingly larger and more modernly constructed halls of today made from steel, stone and concrete need to be filled with sufficient sound, but have stages which are often constructed in a fashion which is too solid to serve as an underlying resonance structure.

Concert organizers occasionally take this situation into consideration by providing podiums not only for conductors but also for instrumental soloists. Same are, however, not built according to acoustical criteria and do not satisfy the practical handling and storage requirements and therefore are not often found in concert halls.

It is therefore the underlying purpose of the invention to create a resonance box of the above mentioned type which facilitates a resonance effect which can be clearly heard and felt, and which amplifies the sound of the corresponding string instrument in that region in which the tonal spectrum is weaker.

SUMMARY OF THE INVENTION

This purpose is achieved in accordance with the invention in that the resonance box is optimized in an acoustical manner through choice of materials, the shape and sounding holes.

By means of the invention a sound improvement is achieved independent of the floor or stage of the concert hall. Although the resonance box is primarily conceived for cellos and double-basses, that is to say for musical instruments which seat on a floor via an end pin, it can also be used to amplify the sound of other string instruments, for example a harp. With regard to the cello and also the double bass, large tonal amplification is achieved as a result of which the above mentioned problems are solved in a completely satisfactory fashion. Significant is that, in contrast to prior art, one is not dealing with a simple wooden podium, rather with a resonance box optimized with regard to the resonance requirements. The material used is generally wood but must not be in each case. When using wood an appropriate selection must be made with regard to the type of wood, the degree of knotting, the structure of the veins and the like. In addition, the shape, for example two trapezoids mutually adjacent at their long sides, is favorable to the tonal amplification. Clearly, however, other shapes are conceivable. The sound holes are important for the achievement of a resonance effect which is superior with respect to its quality to that of a wooden floor or to that of sturdy wooden podiums. In this fashion, the resonance box is more than simply an auxiliary device for use in conjunction with unsuitable flooring; rather it is a device which opens-up new possibilities for the cello and the double-bass.

Improvements of the resonance box are described below which increase the inventive effect, improve the handling and introduce a plurality of additional advantages.

It is advantageous when the upper side of the resonance box is dimensioned in such a fashion that same allows room for the player and for the string instrument to be placed thereon. In this manner, it is possible to arrange a relatively large resonance box having good acoustical properties for the soloist, for example in front of the orchestra. An additional advantage is the visual prominence of the player which, in particular with musical instruments where soloists do not play in a standing position, is favourably received.

It is proposed to have at least two F-holes in the upper side symmetrically configured at both sides of the region of a lid at which the string instrument is placed. This configuration serves for optimal resonance effect. In addition to the lid the upper side advantageously has a floor dimensioned in such a fashion that a player with chair can be placed thereon. In this fashion the cellist can assume his sitting playing position and even the double-bass musician has enough space for the dimensions of his instrument.

It is particularly advantageous when the resonance box is configured in a fashion allowing it to be compacted. This can either be achieved in that the resonance box is configured in a detachable fashion or in that it can be folded together by means of components connected to each other with hinges. In this manner it is possible to transport and store the resonance box in a simple and space-saving fashion. It can therefore, as is a musical instrument, be carried into the concert hall by the musician. The musician is therefore more independent from the prevailing circumstances. In addition, the resonance box protects valuable carpets and flooring since the end pin of the instrument must otherwise be placed upon same. A plurality of means for disassembling the resonance box as well as a plurality of folding mechanisms are conceivable.

A preferred folding mechanism is configured in such a fashion that the upper side has first hinges between the floor and the lid by means of which the floor and lid can be folded onto each other. Side frames are connected to the floor and the lid by means of second hinges in such a fashion that they are pivotable from a position parallel to the floor and the lid up to a stop in a 90° location. Front rails can be inserted in guides, at the front sides of the floor and the lid so that the 90° location of the side frames is locked in place. Stops can position the inserted front rail. In this fashion the resonance box can be assembled and disassembled rapidly and in a convenient fashion. The resonance box has half the area and a depth of only four board thicknesses in the folded-together state.

It is proposed to configure the guides in such a fashion that they can accept tensile forces directed perpendicular to the guiding direction. In this fashion even higher stability of the assembled resonance box is achieved. This can, for example, be attained through dovetailed guides or T-shaped grooves having corresponding T-shaped counter parts. Additional embodiments are conceivable.

In order to store the front rail, it is proposed to arrange mountings on the lower side of the lid and/or floor. Same could consist of angular members for receiving one end of the front rail and magnet mounts for securing the other end.

An improved transportability is achieved by configuring at least one support girder in such a fashion that the resonance box can be carried by means of same in its folded together state. A particularly advantageous configuration of two support girders is one in which the side frames of the lid have openings in their forward region and the side frames of the floor in their rear region through each of which one support girder passes. In this fashion the support girders are multifunctional, not only as a support but also as a holding means. In the assembled state it is possible for the support girders to be tensioned by appropriate dimensioning of their length as a result of which they exercise a force on the side frames in such a fashion that same securely hold the front rails in their inserted positions. In the event that the folded-together resonance floor is grasped at these two support girders, forces are exercised which maintain the folded-together state and simultaneously secure the front rails in their stored position. In this fashion it is not even necessary to provide for an additional strap for holding together purposes. A hanger is formed by the folding together of the side rails by means of which the support girders can be placed over the shoulder so that both hands remain free and the musical instrument can be simultaneously transported.

Peripheral edge lips can be introduced onto the outer edges in order to prevent slippage-off from the resonance box. These edge lips could include both the floor as well as the lid. This is particularly advantageous for the case of the floor in the event that a chair is placed upon same. In one embodiment, the edge lips are formed in the assembled state from frame and front rail components projecting above the upper side. It is, however, also possible to directly place the edge lips on the upper side, preferentially of the floor.

The following measures serve to improve the resonance and tonal characteristics:

The lid of the resonance box can have a curved upper surface. This causes an increase in the loadability as a result of which thinner wood could be utilized leading to a reduction in weight and improvement in tone. In addition, in this fashion, an aesthetic resonance box design is achieved.

A bass bar can be introduced on the lower side of the lid which is advantageously arranged, as viewed by the musician, at the left side of the symmetry axis parallel to same.

The sound holes should run substantially parallel to the symmetry axis analogous to the F-holes of a string instrument.

A user-friendly placement of the instrument can be achieved by providing depressions in the appropriate region of the lid for the placement of the end pin of the instrument; a plurality of depressions are provided in order to take into consideration the requirements of different musicians.

An advantageous improvement provides that the upper side be tilted in the forward direction. In this fashion an influence similar to that of a wedge-shaped pillow is effected for seating the musician as a result of which a healthy seating posture is achieved. The instrumental weight is displaced more onto the instrumental end pin as a result of which the musician is load-relieved. In addition, sound reflection by the upper surface is in the forward direction furthermore leading to additional sound amplification.

The embodiments of the invention are represented in the drawings.

DESCRIPTION OF THE PREFERRED EMBODIMENT

Figure 1:
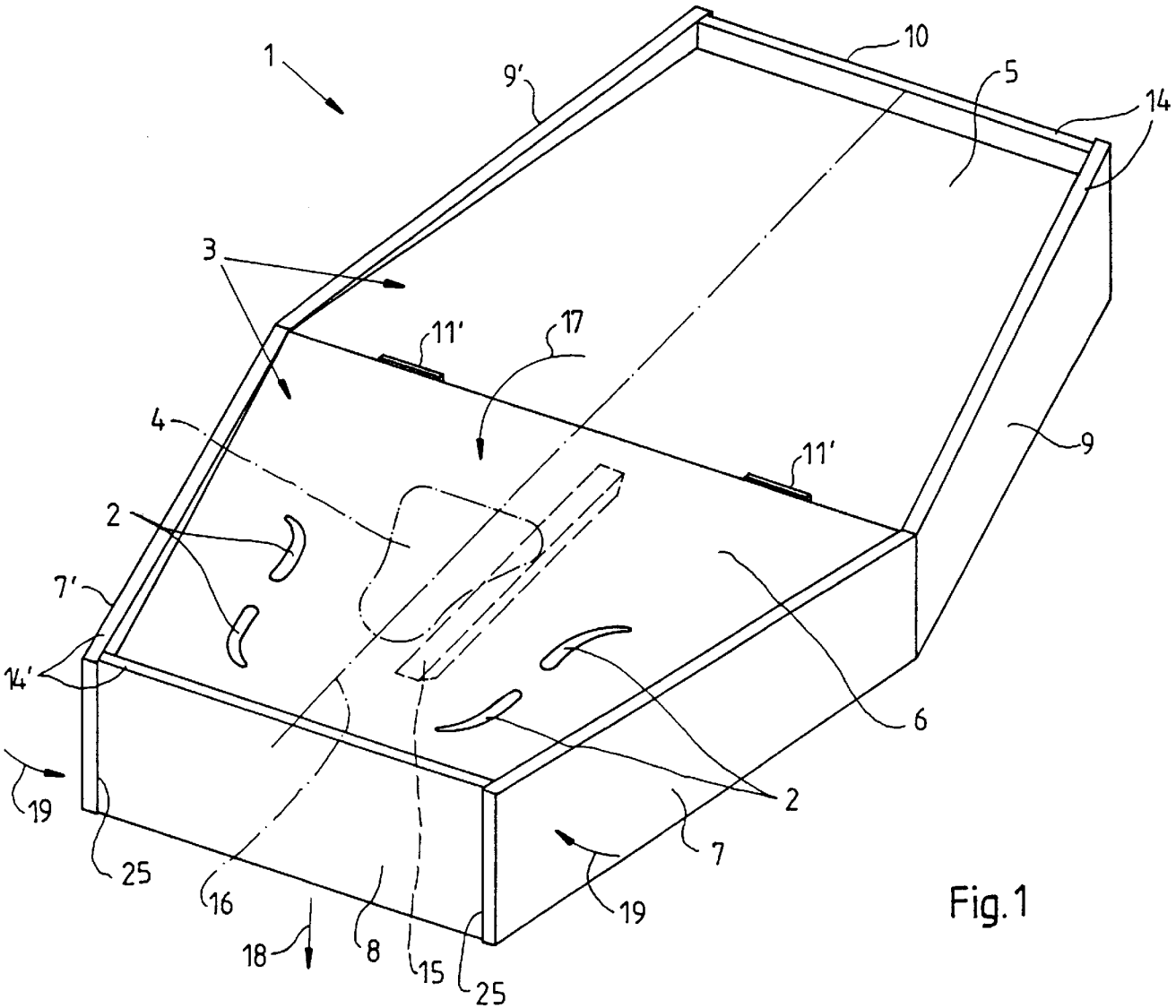
FIG. 1 shows a first embodiment of the resonance box in perspective view.

FIG. 1 shows a first embodiment of the resonance box 1 in perspective view. The upper side 3 consists of a floor 5 and a lid 6. The floor 5 is dimensioned in such a fashion that a musician, preferentially with an accompanying (locally available in the concert hall) chair, can comfortably be seated thereon. A musical instrument, for example having an instrument end pin, is placed on lid 6. The dot-dashed region indicates the placing location. The box is furthermore formed in such a fashion that the lid 6 has sides frames 7 and 7' as well as a forward front rail 8. The floor 5 has corresponding side rails 9 and 9' as well as a rear front rail 10.

In order to be able to easily transport and store the resonance box, it is advantageous when the described components are compactable to as small a volume as possible. In this embodiment this is achieved in that the floor 5 is connected to the lid 6 by means of first hinges 11'. These could be one continuous hinge or a plurality, preferentially two, hinges 11'. In the event that the floor 5 and the lid 6 are configured with approximately comparable size and shape, it is possible for the surface to be halved when the floor 5 and the lid 6 are folded onto each other at their upper sides in correspondence with arrow 17. Clearly, this is also possible in the other direction. In the present embodiment, trapezoidal shapes have been chosen for both the floor 5 and the lid 6 wherein same are connected to each other at their long sides by means of the hinges 11'.

Guides 25, by means of which the front rails 8 and 10 can be pulled-out, serve for additional folding together wherein the side frames 7, 7', 9, 9' can be folded-in by means of two hinges 11". This is described with regard to FIGS. 2 through 4.

The embodiment of the resonance box 1 shown is configured in a symmetric fashion. The symmetry axis 16 is drawn as a dot-dashed line. The region 4 at which the string instrument is placed is located on this symmetry axis 16. A bass bar 15 (drawn with a dashed line) is introduced below the lid 6 at, as viewed by the musician, the left side of the symmetry axis 16. Two sound holes 2 are located, in each case, between the symmetry axis 16 and the outer edge of the lid 6. These are elongated in shape and extend in the longitudinal direction. They correspond to the F-holes of string instruments with regard to their shape and location.

The floor 5 and the lid 6 are folded onto each other when folding together the resonance box 1 as described and subsequently, as shown by arrow 18, the forward front rail 8 is pulled-out. The side frames 7 and 7' freed thereby can subsequently be folded-in in such a fashion that they extend parallel to the lid 6. The rear front rail 10 is also pulled-out and the side frames 9 and 9' of the floor 5 folded-in in a comparable fashion. In this manner, the resonance box 1 can be folded together to as small a volume as possible as a result of which it is easy to transport and store.

Figure 2:
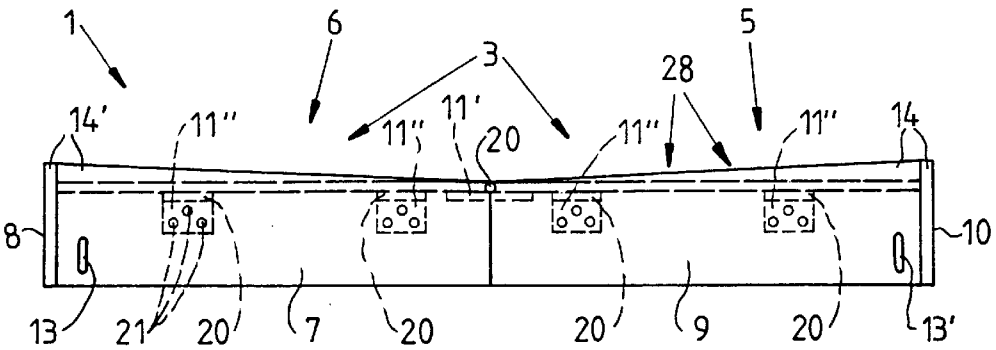
FIG. 2 shows a side view.

FIGS. 2 (side view), 3 (front view) and 4 (plan view) show configurations of the hinges 11.

Only the hinge joints 20 of the first hinges 11' are viewable from above. The attachment tabs of these hinges 11' are mounted below the upper side 3 by means of hinge mounts 21. As a result these are largely non-visible, however, configured in such a fashion to facilitate folding together of the floor 5 and the lid 6 at their upper side.

Figure 3:
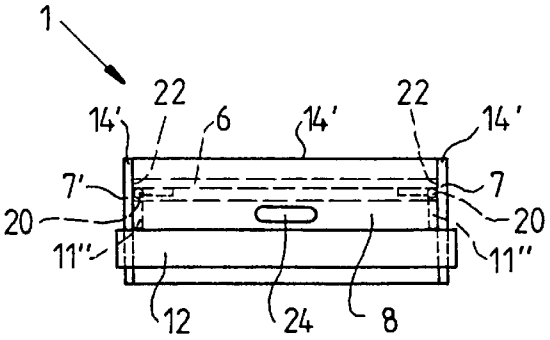
FIG. 3 shows a front view.

The front rail 8 is shown in its inserted position. In the event that same is pulled-out in the direction of arrow 18 it is possible to fold together the side frames 7 and 7'. The location of the hinge joint 20 of the second hinge 11" can be extracted from FIGS. 2 and 3. FIG. 3 also shows how the outer sides of the lid 6 serve as stops 22 by means of which the side frames 7 and 7' can be held in their 90° position.

Figure 6:
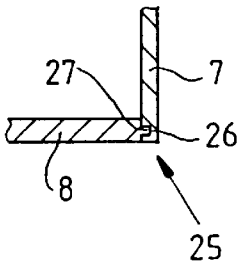
FIG. 6 shows a first embodiment of the cut VI—VI of FIG. 5.
Figure 6A:
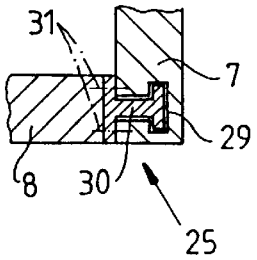
FIG. 6*a* shows a second embodiment of the same cut.

A stabilization of the side frames 7 and 7' with respect to an unintentional folding-in is facilitated in that the forward front rail 8 holds these side frames 7 and 7' after it is inserted. This can be seen from FIGS. 1 through 4. Embodiments of the guides 25 of the front rails 8 and 10 are shown in FIGS. 6 and 6*a*.

This description is also applicable in a corresponding manner to the floor 5 and its sides frames 9 and 9' as well as the rear front rail 10.

The side frames 7, 7', 9 and 9', located in their 90° position, as well the front rails 8 and 10 form the edged bridges 14 and 14'. As can be viewed from FIG. 2 these edge bridges 14, 14' are also configured in such a fashion that they are raised in the vicinity of the forward front rail 8 and of the rear front rail 10 and taper therefrom towards the center of the resonance box 1 in a wedge-shaped fashion 28 with respect to the upper side 3.

FIG. 2 additionally shows openings 13 and 13' located on the front ends of the side frames 7 and 7' as well as on the rear ends of the side frames 9 and 9'. These openings 13 and 13' serve for the passage of support girders 12, one of which is shown in FIG. 3. Towards this end FIG. 3 shows how the support girder 12 is rigidly spanned in the assembled state of the resonance box 1 as a result of which a tensile force is exercised on the side frames 7, 7' to secure the front rail 8. In the event that the side rail 8 is pulled-out by overcoming this securing force, towards which end a handle 24 is useful, then the side frames 7, 7' can be folded-in. This folding-in reduces the separation between the openings 13, 13' and the support girder 12 forms a hanger for purposes of carrying. Clearly, same is also true for the sides of the floor 5. In addition, the support girders 12 effect, in their folded-together state, additional support in opposition to unintentional folding-out when the resonance box 1 is carried.

Clearly, other additional measures are also conceivable for facilitating holding of the folded-together state. Towards this end detachable snapping connections or magnet holding means can be provided for.

Figure 4A:
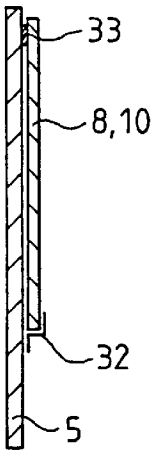
FIG. 4*a* shows a cut view illustrating storage of the front rail.
Figure 4:
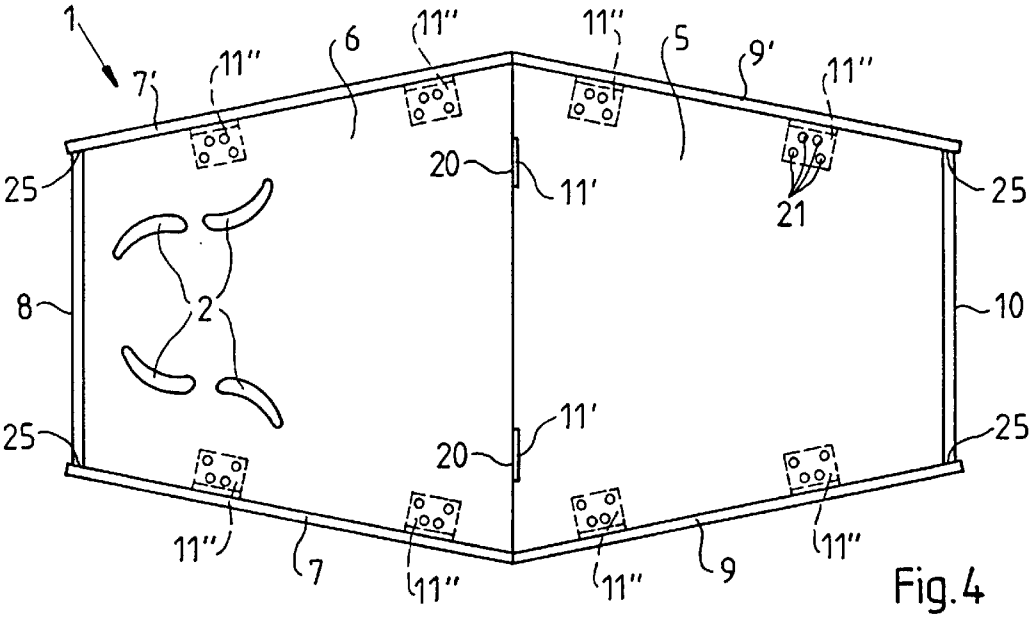
FIG. 4 shows a plan view.

FIG. 4*a* shows a cut with one of the front rails 8 or 10 in the storage position. Towards this end the front rails 8, 10 are inserted with one side in an angle means 32 which is located at the bottom of the floor 5 or the lid 6 of the folded together resonance box 1 and held at the other side by means of a mounting, for example, by means of a magnet mount 33.

Figure 5:
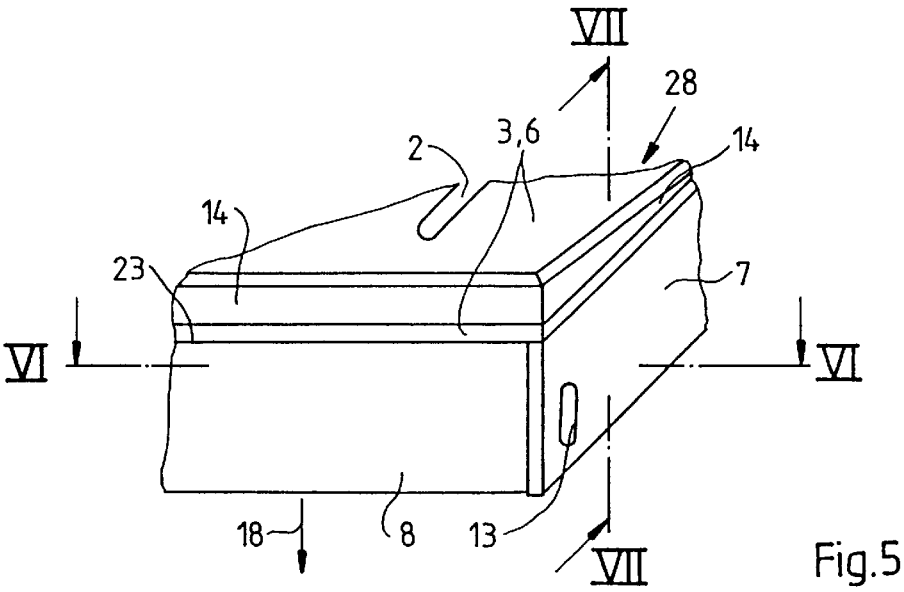
FIG. 5 shows a second embodiment in perspective partial view.
Figure 7:
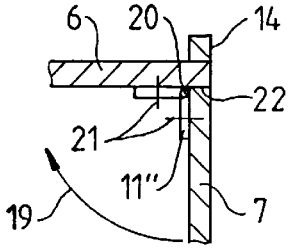
FIG. 7 shows a cut VII—VII of FIG. 5.

FIGS. 5, 6, 6*a* and 7 show a second embodiment, wherein FIG. 5 shows a partial perspective view, FIG. 6 a cut VI—VI of FIG. 5 in a first embodiment, FIG. 6*a* the same cut in a second embodiment and FIG. 7 a cut VII—VII of FIG. 5.

In contrast to the first embodiment, both the side frames 7 and 7' as well the forward front rail 8 are mounted below the surface of the lid 6. This is clearly also true for the floor 5 (not shown) with the frames 9 and 9' and the rear front rail 10.

In this embodiment the upper edge of the forward front rail 8 functions as a stop 23 since same abuts on the lower side of the lid 6 when the front rail 8 is inserted. As already described above, the front rail 8 also prevents an unintentional folding-in of the side frames 7 and 7' in this embodiment.

FIG. 6 shows a first embodiment of the guide 25. It comprises a front rail 8 having a spring 27 which engages into a groove 26 of the side frame 7. A holding-together effect achieved, holding the front rail 8 with the assistance of the above described holding function of the support girder 12.

The second embodiment represented in an enlarged fashion in FIG. 6*a* achieves increased stability. A double-T section 30 is introduced onto the front rail 8 by means of a section mount 31. Same is inserted into a corresponding T-shaped groove 29 of the side frame 7.

Clearly, other guides 25 are conceivable, for example dovetailed guides.

FIG. 7 shows the second hinges 11' for the side frames 7 and 7'. The stop 22 can be seen in this representation.

In the embodiment of FIGS. 5 through 7, the edge bridge 14 is formed by strips introduced onto the upper sides 3.

The above description is also valid for the embodiments of the floor 5. Like reference symbols thereby correspond to the components described with regard to the first embodiment. Other functions and possibilities for improvement are analogous to those described above.

Clearly, an additional plurality of embodiments of the resonance box 1 are conceivable, for example it could also have the shape of two triangles or squares or be provided with a different folding means. The dimensions are clearly variable in an arbitrary fashion. They are adjusted to the individual requirements of the musical instrument, musician, chair, and the like.

I claim:

1. A resonance box for sound amplification of a string instrument being played by a musician, the string instrument having an end pin for supporting the string instrument, the resonance box comprising:

a floor for supporting the musician;

a lid having sound holes, said lid for supporting the end pin for sound amplification of the string instrument;

first hinges connecting said floor and said lid for folding together said floor and said lid at an upper side of said resonance box;

side frames;

a stop;

second hinges connecting said side frames to said floor and said lid for pivoting said side frames from a parallel position up to said stop into a 90° position;

guides at a front side of said floor and said lid; and front rails insertable into said guides to lock-up said 90° position of said side frames.

2. The resonance box of claim 1 further comprising mountings arranged at a lower side of at least one of said lid and said floor for storage of said front rails.

3. The resonance box of claim 2, wherein said mountings comprise angle means for accepting a first end of said front rails and magnet mounts for securing a second and of said front rails.

4. A resonance box for sound amplification of a string instrument being played by a musician, the string instrument having an end pin for supporting the string instrument, the resonance box comprising:

a first region for supporting the musician;

a second region having a lid with sound holes, said lid for supporting the end pin for sound amplification of the string instrument;

means for compacting the resonance box to a reduced volume, wherein said resonance box comprises components and said compacting means comprises first hinges connecting said components for folding-together of said components; and means for carrying said resonance box in a folded-together state.

5. The resonance box of claim 4, wherein said resonance box comprises a lid having side frames with openings in a forward region thereof for passage of said girder and a floor having side frames with openings in a rear region thereof for passage of said girder.

6. The resonance box of claim 5, wherein said resonance box further comprises:

side frames;

guides at a front side of said floor and said lid; and front rails insertable into said guides, wherein said girder has a length dimensioned to exercise a force on said side frames when said front rails are inserted in said guides to hold said front rails.

7. A resonance box for sound amplification of a string instrument acoustically connected therewith, the resonance box having sound holes, an acoustically optimized shape and being made from an acoustically optimized material, the resonance box comprising a floor having an edge bridge surrounding said floor at an outer edge thereof, wherein said edge bridge consists essentially of frame and front rail components projecting above an upper side of said resonance box.

8. A resonance box for sound amplification of a string instrument acoustically connected therewith, the resonance box having sound holes, an acoustically optimized shape and being made from an acoustically optimized material, the resonance box comprising a floor having an edge bridge surrounding said floor at an outer edge thereof, wherein said edge bridge extends vertically above an upper side of said resonance box.

9. The resonance box of claim 8, wherein the resonance box consists essentially of wood.

10. A resonance box for sound amplification of a string instrument being played by a musician, the string instrument having an end pin for supporting the string instrument, the resonance box comprising:

a floor having a size and a strength for supporting the musician thereon; and a lid adjacent to said floor having sound holes, said lid acoustically structured for supporting the end pin) acoustically structured for sound amplification of the string instrument when the end pin seats on said lid.

11. The resonance box of claim 10, wherein said lid has a first and a second pair of sound holes, configured symmetrically at first and second sides of the end pin.

12. The resonance box of claim 10, wherein said size and said strength are structured to support a chair for placement on said floor.

13. The resonance box of claim 10, further comprising means for compacting the resonance box to a reduced volume.

14. The resonance box of claim 13, wherein said compacting means for disassembly of the resonance box.

15. The resonance box of claim 13, wherein said compacting means comprises first hinges connecting said floor and said lid for folding-together the resonance box.

16. The resonance box of claim 10, wherein said lid has a curved upper surface.

17. The resonance box of claim 10, further comprising a bass bar arranged on a lower side of said lid at a musician's left side of a symmetry axis.

18. The resonance box of claim 17, wherein said bass bar is parallel to said symmetry axis.

19. The resonance box of claim 10, wherein said sound holes extend largely parallel to a symmetry axis analogous to F-holes of string instruments.

20. The resonance box of claim 10, wherein said lid has a depression for acceptance of the end pin of the string instrument.

21. The resonance box of claim 10, wherein said floor and said lid comprise trapezoidal-shaped components having long sides of equal length which are connected to each other.

22. The resonance box of claim 10, wherein said lid is tilted in a forward direction.

23. A resonance box for sound amplification of a string instrument being played by a musician, the string instrument having an end pin for supporting the string instrument, the resonance box comprising:

a floor having a size and a strength for supporting the musician thereon;

a lid adjacent to said floor and having sound holes, said lid acoustically structured for sound amplification of the string instrument when the end pin seats on said lid; and first hinges connecting said floor and said lid for folding together said floor and said lid at an upper side of the resonance box.

24. A resonance box for sound amplification of a string instrument being played by a musician, the string instrument having an end pin for supporting the string instrument, the resonance box comprising:

a floor having a size and a strength for supporting the musician thereon;

a lid adjacent to said floor and having sound holes, said lid acoustically structured for sound amplification of the string instrument when the end pin seats on said lid;

first hinges connecting said floor and said lid for folding together said floor and said lid at an upper side of the resonance box;

side frames; and second hinges connecting said side frames to said floor and said lid for pivoting said side frames from a parallel position into a 90° position.

* * * * *